United States Patent [19]

Dessauer

[11] 4,029,506

[45] June 14, 1977

[54] UNIVERSAL PRODUCT CODE MARKING COMPOSITION CONTAINING A PHOTOSENSITIVE DYE FORMER, A PIGMENT AND A BINDER AND THE USE THEREOF

[75] Inventor: Rolf Dessauer, Greenville, Del.

[73] Assignee: E. I. Du Pont de Nemours and Company, Wilmington, Del.

[22] Filed: Sept. 22, 1976

[21] Appl. No.: 725,585

Related U.S. Application Data

[63] Continuation-in-part of Ser. No. 516,483, Oct. 21, 1974, abandoned.

[52] U.S. Cl. ..... 96/48 R; 96/48 QP; 96/27 R; 96/90 R; 106/21

[51] Int. Cl.[2] ..... G03C 5/24; G03C 1/52

[58] Field of Search ..... 96/88, 90 R, 90 PC, 96/29 R, 48 R, 27 R, 48 QP; 106/21

[56] References Cited

UNITED STATES PATENTS

| | | | |
|---|---|---|---|
| 3,578,450 | 5/1971 | Miller et al. | 96/29 R |
| 3,615,454 | 10/1971 | Cescon et al. | 96/48 R |
| 3,658,543 | 4/1972 | Gerlach et al. | 96/90 R |
| 3,660,086 | 5/1972 | Tamai et al. | 96/90 PC |
| 3,736,142 | 5/1973 | Kaspaul et al. | 96/90 R |
| 3,810,763 | 5/1974 | Laridon et al. | 96/90 PC |
| 3,871,886 | 3/1975 | Robillard et al. | 96/90 PC |
| 3,940,275 | 2/1976 | Brockett et al. | 106/21 |

*Primary Examiner*—Won H. Louie, Jr.

[57] ABSTRACT

Described are a marking composition of a color-forming, radiation-sensitive component, a diffusely reflecting pigment and a binder, and a process for the use of the same comprising coating a product surface with the marking composition; exposing the coating to a pattern of radiation to form a marking; and then reading the marking with a diffuse reflectance scanning means.

7 Claims, No Drawings

UNIVERSAL PRODUCT CODE MARKING COMPOSITION CONTAINING A PHOTOSENSITIVE DYE FORMER, A PIGMENT AND A BINDER AND THE USE THEREOF

RELATED APPLICATION

This application is a continuation-in-part of my copending application Ser. No. 516,483, filed on Oct. 21, 1974, now abandoned.

BACKGROUND OF THE INVENTION

Continuing effort has been directed toward the development of more satisfactory means for inventory control and supermarket checkout procedures. These efforts have resulted in a Universal Product Code (UPC), presented as an array of bars and spaces. Codes of this type are readable by a diffuse reflectance scanning means.

Despite the overall workability of this system, difficulty has been encountered in the development of a satisfactory means for applying the coded message. Traditional graphic art printing techniques, using two inks for the bars and the spaces, respectively, are limited by the tendency of the ink to spread during application. Moreover, the UPC system has minimum contrast requirements between the bar code and the background, since the coded information is read by detecting diffusely scattered light as reflected by the bars and the background. Accordingly, a continuing need exists for a reliable system for applying UPC codes efficiently and accurately to a wide variety of substrates.

SUMMARY OF THE INVENTION

The present invention provides a marking composition particularly well suited for the application of UPC codes, and a process for its use in applying such codes. The composition, when so used, results in the contrast required for this system independent of the reflective properties of the substrate, and provides a simplicity, precision and economy heretofore not available.

Specifically, the instant invention provides a marking composition comprising:

a. A colorless, radiation-sensitive composition which, upon exposure to radiation, is capable of forming a substantially permanently colored substance that can absorb at least a portion of the wavelength of light in the visible spectrum, b. Pigment capable of diffusely reflecting the wavelengths of light absorbed by the colored substance, and c. Radiation-transmissive, colorless polymeric binder capable of providing coating adhesion to the surface of a substrate, the quantity of pigment comprising about from 3 to 12 percent by volume of the combined components (a), (b) and (c) and the radiation-sensitive composition being present in an amount sufficient to produce, upon exposure to radiation, a detectable difference in diffuse reflectance density between exposed and unexposed areas.

The invention further provides a process for marking an object by applying to an exterior surface of the object a marking composition as described above, and exposing the resulting coating to a pattern of radiation of a wavelength to which the radiation-sensitive composition is sensitive, to produce a detectable difference in diffuse reflectance density between exposed and unexposed areas.

DETAILED DESCRIPTION OF THE INVENTION

Radiation-sensitive components which can be used in the present invention are any of the known compositions that are normally colorless and unaffected by ambient light conditions but are colored by exposure to suitable electromagnetic radiation. Particularly satisfactory are those described in Hughes U.S. Pat. No. 3,639,762 issued Feb. 1, 1972, hereby incorporated by reference. That patent discloses appropriate ambient light conditions and sources of electromagnetic radiation for forming colored substances from the radiation-sensitive compositions listed. Such components are substantially colorless. However, slight color present before irradiation will now interfere with attaining sufficient contrast between bars and spaces under examining colored light. Typically, such radiation-sensitive components comprise dye-forming materials but may contain still other materials to fix the dye image against further color change. These compositions are photoimageable and photofixable and are dry processing in that they require no treatment other than irridation with two different types of irradiation.

Other radiation-sensitive components which can be used are the photoimaging-heat fixing systems which are also dry processing, requiring only light and heat and no chemical treatment whatsoever to develop and fix the image. Such a system is shown in detail in Manos, U.S. Pat. No. 3,390,995, hereby incorporated by reference. UV-sensitive components which include various chemical, thermal, or light-activated (photofix) agents as known in the art and described in U.S. Pat. Nos. 3,390,994; 3,390,995; 3,390,996, 3,445,234; 3,630,736; 3,615,454 and 3,658,543, are suitable for use in the present invention.

Reflective pigments which can be used in this invention must be capable of diffusely reflecting the wavelengths of the examining light, the amount of such a pigment being at least sufficient to opacify the surface of the object, but not so much as to hide the colored substance formed by the exposure to radiation. The quantity of pigment accordingly comprises at least about 3 by volume of the combined pigment, binder, and radiation-sensitive material. Generally, about from 3 to 12% is used, and about from 5 to 10% by volume has been found particularly satisfactory.

The maximum pigment concentration should provide a sufficient difference in diffuse reflectance density between expose and unexposed areas. The density difference as measured with a MacBeth Reflectance Densitometer, using a visual filter that approximates the sensitivity of the eye, should be at least about 0.4 between exposed and unexposed areas. For opacification of the substrate, the reflectance density of the unexposed areas normally is 0.4 or less, based on a comparison object such as a standard magnesium carbonate surface.

Specific material which can be used as pigments in this invention include paper, felt, natural and synthetic fibers, plastics, ceramics, and powdered glass (silica), as well as inorganic oxide, sulfide, and carbonate powders. Especially suited however are particulate metal oxide and sulfide pigments, particularly where the metal is a polyvalent heavy metal having an atomic number of at least 21, heavy metal being defined as in H. G. Deming's Fundamental Chemistry, Second Edition, John Wiley and Sons. Representative examples are antimony and bismuth trioxide; hafnium, zirconium, and bismuth dioxide; lead monoxide; tin dioxide; yttrium oxide; zinc; cadimum, and mercuric oxides. Suitably colored corresponding sulfides may also be used, e.g., zinc sulfide. Especially preferred are $TiO_2$ (rutile), ZnO (including zincite), zinc sulfide (wurtzite, sphalerite, blende) including lithopone, $SnO_2$ and $ZrO_2$.

The particular pigment chosen will of course be compatible with the radiation-sensitive composition and the colored substance produced therefrom upon irradiation in the marking step.

The pigment can be selected to absorb upon its surface the dye developed by irradiation. Acidic oxides can be employed in combination with photosensitive components that develop cationic dyes. Most preferably, titanium dioxide and a cationic triarylmethane dye-forming component are used in the coating composition.

Colored pigments can sometimes be used for an additional identification purpose. However, the color of the pigment should not be so pronounced as to interfere with the minimum required contrast at the wavelengths of the examining light. Yellow cadmium sulfide pigment, for example, is compatible with the development of red light-absorbing dye.

The diffuse reflectances afforded by various pigments vary depending upon their chemical nature and average particle or fiber sizes. Visible light scattering is known to be a function of the surface area per gram. Accordingly, the smaller the particle size, the greater the visible light scattering powr. Pigments having an average particle size of about from 0.04 to 50 microns are commercially available and can be used in this invention. Smaller particle sizes within the stated range are particularly satisfactory. The amount of pigment of given average particle size and scattering surface necessary to meet reflectance and contrast criteria defined herein can be readily determined by those skilled in the art. In general, lower quantities of smaller size pigment particles are needed.

The polymeric binder serves to form a coating that is sufficiently adherent to the object to be marked to be retained at least until automated checkout can take place. The binder-pigment combination is generally chosen to provide a dimensionally stable marking, as by choosing a polymer that is a stiff binder for the pigment employed. The pigment itself generally contributes to the dimensional stability. The binder should be capable of transmitting sufficient radiation to the radiation-sensitive component to form the colored substance in a reasonably short time, so as not to unduly impede marking during manufacture or in the store. The light absorbing properties of the binder should be compatible with those of the radiation-sensitive composition, the dye produced therefrom and the pigment. The binder should be capable of transmitting the examining colored light corresponding to the absorption color developer by the photosensitive component. Normally it will be substantially colorless.

The polymeric binder also contributes dimensional stability, i.e., maintains the widths and locations of exposed and unexposed areas established during exposure until such time that the information conveyable thereby can be read by a scanner.

Light transparent polymers which can be used as binders include ethyl cellulose; polyvinyl alcohol; polyvinyl chloride; polystyrene; polyvinyl acetate; polymethyl methacrylate; cellulosic esters such as cellulose acetate, cellulose butyrate, cellulose acetate butyrate, and cellulose nitrate; chlorinated rubber, copolymers of the above vinyl monomers; polyurethanes from about 0.5 part to 200 parts by weight per part of the photosensitive component. Preferably, about from 0.5 to 10 parts are used to maintain adhesion to the object to be marked while promoting the depth of the absorption color developed upon irradiation.

Particularly satisfactory marking compositions of the invention comprise titanium dioxide pigment, a triarylmethane cationic dye-forming component, a UV-activated photooxidant, and a binder such as cellulose acetate butyrate, wherein the photosensitive component comprises an intimate admixture of: a. a salt of an oxidizable leuco aminotriarylmethane and a strong acid which forms a salt with an anilino amino group, b. a hexaarylbiimidazole which absorbs principally n the ultraviolet region and is a photooxidant for the leuco aminotriarylmethane, and c. a redox couple containing (1) as an oxidant a polynuclear quinone absorbing principally in the 430 nm. to 550 nm. region, and (2) a reductant component consisting essentially of 0 to 90% of a lower alkyl steel of nitrolotriacetic or nitrilopropionic acid and from 100 to 10% of an acyl ester of triethanolamine of the formula

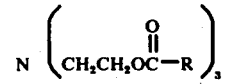

wherein R is alkyl of 1 to 4 carbon atoms.

The compositions are generally prepared by admixing the components in a solvent. The solvent should be volatile at ordinary temperatures and pressures. Examples are alcohols and esters, aromatic hydrocarbons, ketones and miscellaneous solvents in amounts as may be required to attain solution of the radiation-sensitive components.

The order in which ingredients are combined is not critical. The solvent facilities mixing the ingredients of the radiation-sensitive component, but is largely removed from the coating later by evaporation. It is often beneficial to leave a small residue of solvent in the coating applied to the product surface so that the desired degree of color development can be obtained by irradiation.

Coating a surface area of the product with the present compositions involves casting, extruding, or otherwise forming a coating by known methods. Typical devices for applying wet films can be used, such as nip feed three roll reverse coating heads, gravure coaters, trailing blade coaters, knife overroll, 4-roll pan fed, and Mayer bar coating heads. The wet thickness is adjusted such that the dry thickness after solvent removal is from 0.05 to 1.5 mil and usually about from 0.8–1.1 mil.

Product surfaces bearing a composition in solution can be dried at room temperature. They can be also be dried under vacuum at room temperature, by forced air solvent evaporation, or at elevated temperatures. Radiant heating generally should not be used to dry compositions containing IR-sensitive photosensitive components.

After coating of the composition onto a substrate, the coated surface area normally exhibits a substantially uniform diffuse reflection attributable to the pigment dispersed in the coating. Marking requires exposing to appropriate radiation to produce the desired pattern in the coating.

Depending on the nature of the source and pattern-forming optics employed, exposure times will ordinarily vary from a fraction of a second to several minutes. A source of X-ray, UV, or IR radiation is chosen which is appropriate for the radiation-sensitive component used. U.S. Pat. No. 3,639,762 describes the selection and use of radiation sources for various photosensitive marking components, many such combinations being suitable in this invention provided the polymeric binder employed in this invention transmits effective radiation wavelengths. Preferred for use with the preferred UV-sensitive coating compositions described earlier are UV-sources that supply radiation in the region betwen about 200 nm. and about 420 nm.

The optics employed in this invention, however, must be capable of forming a complicated bar symbol of the UPC. Objects with flat surfaces can be marked by contact printing, for example, through a stencil, but objects with irregular and curved surfaces such as the concave bottoms of catsup bottles, are usually easier to mark by projection printing. In either case the radiation is focused on the surface of the object to mark it with an appropriate UPC symbol.

The end utilization of the marked objects involves illuminating the marking with examining light consisting essentially of wavelengths of light absorbed by the colored substance and reflected by the pigment and then reading information conveyable by the predetermined widths and locations of the exposed areas and unexposed areas with a diffuse reflectance scanning means sensitive to the wavelengths of examining light.

Universal Product Code systems generally use a high-speed scanner using a laser light source, such as a red Helium-Neon laser, to read the code's symbol, although other sources such as incandescent lamps can be used with optical filters interposed either between the source of examining light and the marking it illuminates or between the marking and a detector of the diffusely reflected light.

Known diffuse reflectance scanning means suitable for use in this invention include rotating scanners which rotate a very narrow concentrated light beam from a laser, mercury vapor lamp, or an incandescent lamp at speeds of more than 1,000 revolutions per second; and photocells in a fixed position which scan a mark while it is moving in a fixed path. In some applications newly developed hand-held scanners taking the form of a pen or a wand can be used for recording scanned information directly into portable cassettes for storage entry into a computer system.

The preferred coating compositions provide instant access to a marking, i.e., even during UV-exposure exposed areas in which a colored substance is formed are visually distinguishable from unexposed areas in which such substance is not formed. After exposure is complete, final reflectances of the two areas can be tested and quantitatively compared by diffuse reflectance densitometry. Using white light with a visual filter which approximates the response or the human eye, space (unexposed area) reflectance densities remain substantially unchanged at densities, as mentioned, of 0.4 or less compared to a standard magnesium carbonate powder surface. It has been found that enhancement of such visual density by as little as 0.4, i.e., the bar (exposed area) density, makes automatic checkout practical, at least under conditions where coating compositions of this invention form red light-absorbing triarylmethane dye in bar areas and a coherent red HeNe laser beam is used as the examining light in a supermarket. Scanning with laser beam is well known in the art.

The marking compositions of the present invention surprisingly combine, in a single composition, two important characteristics. The composition provide diffuse background reflectance and opacify the surface of the object to be marked without also opacifying the marking itself. It had heretofore not been realized that it would be possible to admix a colorable substance with an opacifying pigment and retain sufficient contrast between exposed and unexposed areas to meet the exacting requirements of UPC markings. In addition, it is surprising that photodegrative pigments such as $TiO_2$ are compatible with the radiation-sensitive compositions and processing used herein in a single composition.

The present composition is universally appreciable as a pigmented coating to a wide variety of surfaces and provides both the reflective background and the less reflective coded message produced upon irradiation. use of the marking composition as shown herein produces images having good resolution and stability, superior to the images of the mechanical printing systems previously used. The accuracy attainable through the present compositions permits a 25% decrease in size of the symbol by avoiding the ink spread problem. In addition, the constraint imposed by mechanical printing systems that bars must lie in the press direction is also removed. These factors give greater freedom in package design.

The present method of marking is independent of the color and other optical properties of the surface of the object to be marked. It is suitable for marking and reading symbols on specularly reflective metal can surfaces, light transmissive glass bottles, and dark or highly colored product surfaces which may have substantially the same color as that developable by the radiation-sensitive comonent used in this method. Special selection or modification of the product surface is not necessary.

The process of this invention is suitable for marking objects during manufacture with UPC symbols to identify the manufacturer and the type and weight of each object. Prices would be shown on supermarket shelves, not on each object, and would be stored in computer memory for use during checkout.

These steps are also suitable for marking film-wrapped products such as fresh meats, fruits, and vegetables packaged in the store with symbols identifying the product and its price.

The process of this invention, in addition to UPC bar code symbols, can be used for applying other symbols and alphanumerics that involve two areas differing in reflectance.

The invention is further illustrated by the following specific Examples, in which parts and percentages are by weight unless otherwise indicated.

EXAMPLE 1

A marking composition was prepared by admixing the following components in the amounts indicated.

| Ingredient | | Amount |
|---|---|---|
| Binder | | |
| Cellulose acetate butyrate (Eastman Chemical Co.) | | 45.0 g |
| Pigment | | |
| Titanium dioxide, rutile form (Du Pont "Ti-Pure" R Titanium Dioxide Pure) | | 15.0 g |
| Coating Solvent - Methylene chloride | | 600 ml |
| Photosensitive Component | | |
| Plasticizer N-ethylp-toluenesulfonamide (Monsanto Chemical Company's Santicizer-3) | | 9.8 g |
| Anion Source - Dodecylbenzenesulfonic acid (Richardson Company Richonic Acid B) | | 10.0 g |
| Photooxidizable Leuco Dye - Tris (N,N-diethylamino-o-tolyl) methane | | 1.80 g |
| Photooxidant-2,2'-Bis(o-chlorophenyl)-4,4',5,5'-tetrakis (m-methoxyphenyl)-1,2'-biimidazole | | 8.36 g |
| Hydrogen Donor - Triethanolamine triacetate | | 11.0 ml |
| Redox Couple Oxidant | Pyrenequinone (1:1 mixture of 1,6- and 1,8-isomers) | 0.070 g |
| | 9,10-Phenanthrenequinone | 1.144 g |
| Redox Couple Reductant | Polyethylene adduct of o-phenylphenol, average formula $C_6H_5—C_6H_4—O(CH_2CH_2O)_{2.23}—H$ | 8.6 g |

This composition is imageable by irradiation with UV light and fixable by irradiation with visible light, and contains about 10% by volume of pigment based on the combined volume of the pigment, binder and radiation-sensitive component.

The marking composition was sprayed on transparent "Mylar" film base and dried to form a coating about 1.0 mil thick. The coating rendered the transparent film opaque. A portion of its surface area was exposed for one minute to 2.75 milliwatts per square cm of UV-light peaked at about 365 nm. and the blue color (red absorption) developed was photofixed by exposure to visible white light (no UV). The diffuse reflectance of the unimaged surface area measures with a MacBeth RD-100 Reflectance Densitometer (visual filter) was about 0.08. The diffuse reflectance of the exposed surface area was 1.10. The contrast was sufficient for UPC marking. After 2 weeks there appeared to be no adverse effects in the coated material, i.e., in sensitometry, from which it was concluded that the symbol produced would be sufficiently stable on the supermarket shelf subject to ambient store light.

EXAMPLE 2

The general procedure of Example 1 was repeated, except that the marking composition had a pigment content of about 3.5% by volume of the pigment, binder, and radiation-sensitive component, and was prepared using acetone solvent instead of methylene chloride. The composition was coated onto a substrate. The coating was exposed to a preferred UV-source to form a bar code symbol in which the bars formed in the exposed areas had a diffuse reflectance density of 0.89, the unexposed areas retaining a density of about 0.37 both as measured with a MacBeth RD-100 Reflectance Densiometer. The symbol was successfully read by a red HeNe laser scanning system at a supermarket.

EXAMPLE 3

A marking composition was prepared by admixing the following ingredients:

| | |
|---|---|
| Binder | |
| Cellulose acetate butyrate | 10.28 g |
| Pigment | |
| Titanium dioxide, rutile form (Du Pont "Ti-Pure" R Titanium Dioxide Pure) | 1.25 g |
| Coating Solvent - acetone | 80.14 g |
| Photosensitive Component | |
| Plasticizer N-ethyl-p-toluenesulfonamide (Monsanto Chemical Company's Santicizer-3) | 2.225 g |
| Anion Source - Dodecylbenzenesulfonic acid (Richardson Company Richonic Acid B) | 0.856 g |
| Photooxidizable Leuco Dye - Tris (N,N-diethylamino-o-tolyl) methane | 0.0154 g |
| Photooxidant-2,2'-Bis(o-chlorophenyl)-4,4', 5,5'-tetrakis (m-methoxyphenyl)-1,2'-biimidazole | 0.7153 g |
| Hydrogen Donor - Triethanolamine triacetate | 1.882 g |
| Redox Couple Oxidant Pyrenequinone (1:1 mixture of 1,6- and 1,8-isomers) | 0.0061 g |
| 9,10-Phenanthrenequinone | 0.10 g |
| Redox Couple Reductant Polyethylene adduct of o-phenylphenol, average formula $C_6H_5$-$C_6H_4$-$O(CH_2CH_2O)_{2.23}$-H | 1.951 g |

This composition was sprayed on glass and shiny aluminum surfaces and dried to form opaque coatings containing about 2.7% $TiO_2$ by volume and having diffuse reflectance densities of 0.37 and 0.33 respectively measured as in Example 2. Both coatings were exposed to UV-light and photofixed with visible light to form blue colored (red absorbing) bar areas. Diffuse reflectance densities of 0.82 and 0.74 were obtained in the bar areas and the symbols were successfully read by a red HeNe laser scanning system at a supermarket.

EXAMPLE 4

The general procedure of Example 3 was repeated, except that 4.8 g of white, relatively coarse zinc oxide powder having an average particle less than 50 microns was used instead of the Titanium dioxide pigment. This composition was sprayed on glass and shiny aluminum to form coatings containing about 7% ZnO by volume, and symbols formed as in 3 were also successfully read by the red HeNe laser scanning system.

I claim:

1. A marking composition comprising:

a. a colorless, radiation-sensitive composition which, under exposure to radiation of the visible spectrum, is capable of forming a substantially permanent dye that can absorb at least a portion of the wavelength of light in the visible spectrum, b. a pigment capable of diffusely reflecting the wavelengths of light absorbed by the dye, the amount of said pigment at least sufficient to opacify the marking composition but not so much as to hide color formed by exposure to radiation, and c. a radiation-transmissive, colorless polymeric binder capable of providing coating adhesion to the surface of a substrate, the quantity of pigment comprising about from 3 to 12 percent by volume of the combined components (a), (b) and (c) and the radiation-sensitive composition being present in an amount sufficient to produce, upon exposure to radiation of the visible spectrum, a detectable difference in diffuse reflectance density between exposed and unexposed areas.

2. A composition of claim 1 wherein the pigment comprises about from 5 to 10% by volume of the combined components (a), (b) and (c).

3. A composition of claim 1 wherein the radiation-sensitive component forms a dye upon exposure to ultra-violet light.

4. A composition of claim 3 wherein the dye is fixed upon exposure to light.

5. A composition of claim 1 wherein the pigment is a heavy metal oxide.

6. A composition of claim 1 wherein the pigment consits essentially of $TiO_2$.

7. A process for marking an object by:

I. applying to an exterior surface of the object a marking composition comprising:

a. a colorless, radiation-sensitive composition which, upon exposure to radiation of the visible spectrum, is capable of forming a substantially permanent dye that can absorb at least a portion of the wavelength of light in the visible spectrum, b. a pigment capable of diffusely reflecting the wavelengths of light absorbed by the dye, the amount of said pigment being at least sufficient to opacify the marking composition but not so much as to hide color formed by exposure to radiation, and c. a radiation-transmissive, colorless polymeric binder capable of providing coating adhesion to the surface of a substrate, the quantity of pigment comprising about from 3 to 12 percent by volume of the combined components (a), (b) and (c) and the radiation-sensitive composition being present in an amount sufficient to produce, upon exposure of radiation of the visible spectrum, a detectable difference in diffuse reflectance density between exposed and unexposed areas; and II. exposing the resulting coating to a pattern of radiation of the visible spectrum to which the radiation-sensitive composition is sensitive, to produce a detectable difference in diffuse reflectance density between exposed and unexposed areas.

* * * * *